United States Patent [19]

Ikehata et al.

[11] Patent Number: 5,013,169

[45] Date of Patent: May 7, 1991

[54] PRINT HEAD HAVING REDUCED NOISE AND VIBRATION CHARACTERISTICS

[75] Inventors: Tsutomu Ikehata; Makoto Yasunaga; Hirofumi Suzuki, all of Saitama, Japan

[73] Assignee: Citizen Watch Company, Ltd., Tokyo, Japan

[21] Appl. No.: 394,416

[22] Filed: Aug. 16, 1989

[30] Foreign Application Priority Data

Aug. 23, 1988 [JP] Japan ..... 63-109640[U]

[51] Int. Cl.[5] ..... B41J 2/28; B41J 11/20

[52] U.S. Cl. ..... 400/124; 101/93.05; 400/690

[58] Field of Search ..... 400/124 GT, 124, 689, 400/690; 101/93.05

[56] References Cited

U.S. PATENT DOCUMENTS

| | | | |
|---|---|---|---|
| 4,135,830 | 1/1979 | Hishida et al. | 400/690 |
| 4,758,693 | 7/1988 | Hoffman | 200/11 TW |
| 4,872,851 | 9/1989 | Babuka et al. | 439/267 |
| 4,875,839 | 10/1989 | Sakata et al. | 29/156.8 R |
| 4,884,905 | 12/1989 | Smith | 400/124 |

FOREIGN PATENT DOCUMENTS

| | | | |
|---|---|---|---|
| 0212077 | 12/1982 | Japan | 400/689 |
| 0012861 | 1/1984 | Japan | 400/124 GT |
| 0019169 | 1/1984 | Japan | 400/689 |
| 0209889 | 11/1984 | Japan | 400/124 GT |
| 0229348 | 12/1984 | Japan | 400/124 GT |
| 0042062 | 3/1985 | Japan | 400/689 |
| 0172574 | 9/1985 | Japan | 400/689 |
| 0178078 | 9/1985 | Japan | 400/689 |
| 0061865 | 3/1986 | Japan | 400/689 |
| 0217259 | 9/1986 | Japan | 400/689 |
| 0011654 | 1/1987 | Japan | 400/689 |
| 0092856 | 4/1987 | Japan | 400/689 |
| 0078754 | 4/1988 | Japan | 400/689 |

OTHER PUBLICATIONS

IBM Technical Disclosure Bulletin, vol. 32, No. 9A, Feb. 1990.

Vectra, "Liquid Crystal Polymer", Engineering Plastics Division Hoechst Celanese Corporation, 1988.

*Primary Examiner*—Edgar S. Burr

*Assistant Examiner*—John S. Hilten

*Attorney, Agent, or Firm*—Wenderoth, Lind & Ponack

[57] ABSTRACT

An improved print head for a dot matrix printer is provided. The printing is performed by wires projecting from said print head. The movement of the wires is controlled by the movement of armatures which contact an armature base. The construction of the base from a liquid crystal polymer or an aromatic series polyester resin results in improved vibration damping which in turn results in quieter printer operation.

4 Claims, 4 Drawing Sheets

Attenuation characteristics and elasticity modulus in various materials

VECTRA A230: 30% carbon fiber-filled
VECTRA A950: carbon fiber-unfilled
PPS: polyphenylene sulfide

PRINT HEAD HAVING REDUCED NOISE AND VIBRATION CHARACTERISTICS

BACKGROUND OF THE INVENTION

The present invention relates to a print head of a printer.

PRIOR ART

A conventional print head is disclosed in Japanese Utility Model Laid Open No. 62-94843, filed by different inventors for the present assignee.

That print head consists of an armature unit having an armature base, a solenoid unit having a solenoid base and a wire unit having a nose portion.

Plural armatures and armature springs are circularly arranged with respect to the armature base and also magnetic drive units having a core and a solenoid corresponding to each armature are installed on the armature base.

Plural wires are connected to each armature at one end and project through a nose portion at the other end. The wires project from a front face via operation of the armature by driving of the magnetic drive unit and thus print dots in a matrix that form a printed character on a piece of paper or other substrate.

DEFECTS OF SUCH CONVENTIONAL PRINT HEAD

The described conventional print head uses polyphenylene sulfide (hereinafter referred to as PPS) as a material of the armature base.

It has a defect in that the armature base produces a high level of noise.

The armature base of such a print head is required to have excellent resistance to thermal deformation properties and resistance to wear.

Resistance to thermal deformation is required for preventing irregular printing caused by deformation of the armature base by the heat from plural magnetic drive units which cause high temperatures.

Resistance to wear is required for preventing a reduction in the life of the print head due to wear of the armature base caused by numerous sliding or bumping actions thereon.

PPS is excellent in resistance to thermal deformation and wear but it is poor in preventing vibration and is very noisy upon printing.

As a means for preventing this noise, the addition of metal to the rear face of the armature base is disclosed in Japanese Utility Model Publication 62-32857. However, the resultant print head is heavy due to the presence of the metal. Thus, it is necessary to increase the power of the motor, enlarge the timing belt, and thicken the related shafts for moving the carriage body with the heavier print head thereon.

The inertia of such a print head has a substantial effect on the quality of the printing, and it is also uneconomical in that it requires many parts. The printing is affected in that the increased inertia slows the rate of change of the direction of printing, and the speed of moving the carriage can not match the speed of the print head as closely. Accordingly, in such printers where the print head is reciprocated to begin each line, the beginning of each successive line of print is affected, characters are misaligned, and the quality of printing deteriorates.

An object of the present invention is to eliminate the above-discussed defects of the conventional print head by means of forming the armature base from materials having good resistance to thermal deformation, wear, and vibration.

BRIEF SUMMARY OF THE INVENTION

The foregoing defects are eliminated by the use of an armature base formed from a liquid crystal polymer of an aromatic series polyester resin which has damping properties in addition to resistance to thermal deformation and wear.

Therefore, vibration attenuation of various noises which are caused during operating of the print head occurs quickly and noises radiated from the print head are reduced.

The force of impact from bumping of the armature may be absorbed by the armature base because it is formed from the liquid crystal polymer of aromatic series polyester resin.

Therefore, noise which occurs upon the striking or bumping of the armature may be kept very low, and a low noise printer is thus provided.

BRIEF DESCRIPTION OF THE DRAWINGS

The present invention will now be described more fully with reference to the accompanying drawings, in which.

DETAILED DESCRIPTION OF THE INVENTION

Figure 1:
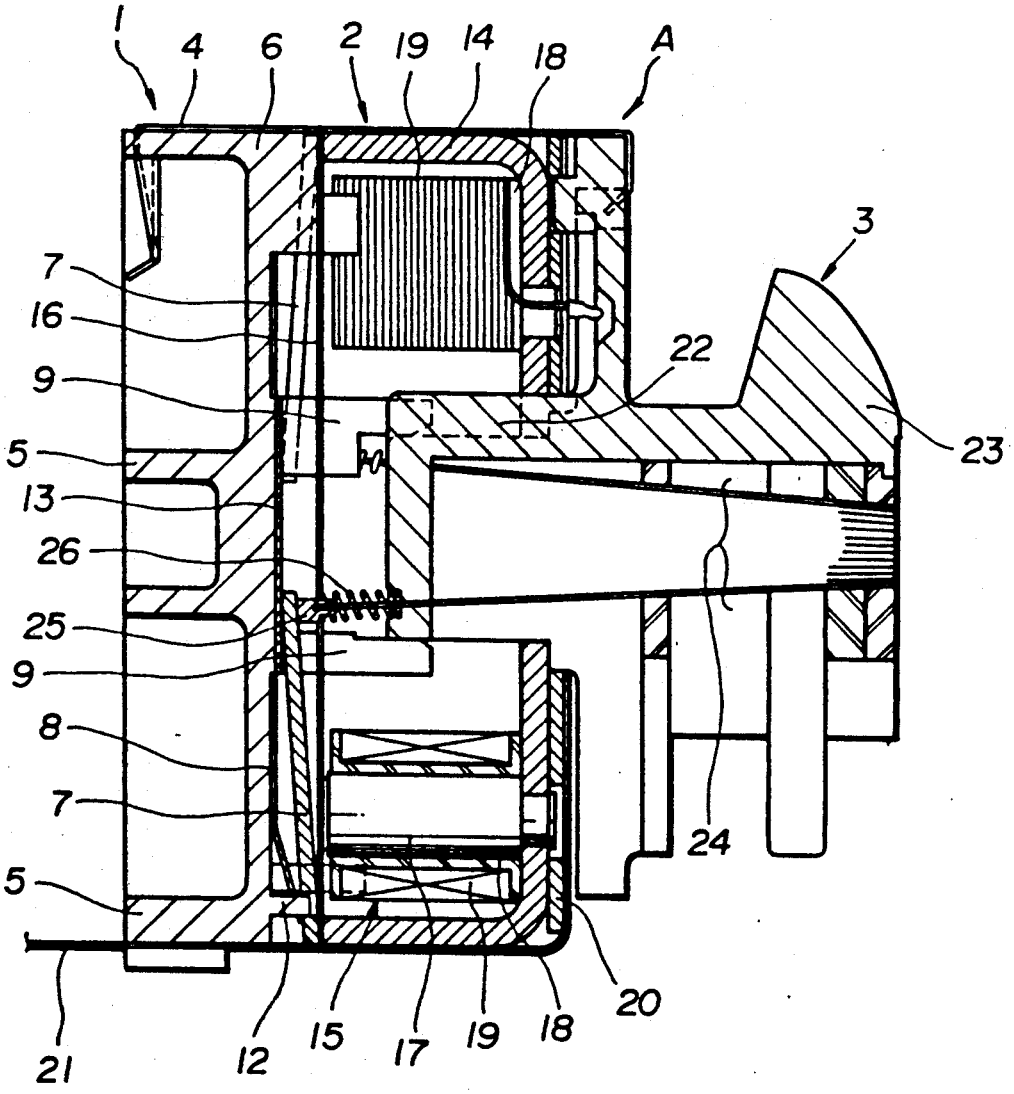
FIG. 1 is a longitudinal sectional view of an embodiment of the present invention.
Figure 2:
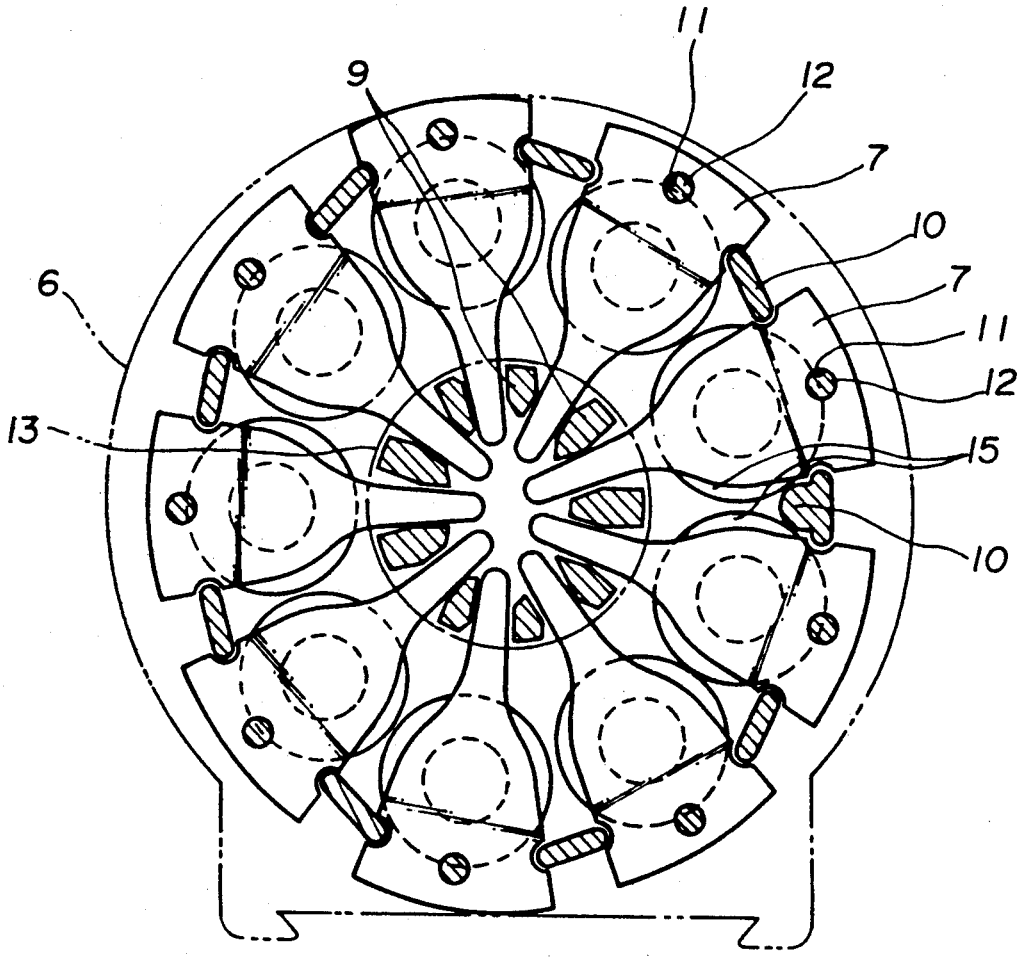
FIG. 2 is a sectional view showing the guiding of the armature.

First, the construction of an embodiment of the present invention is as depicted by FIGS. 1 and 2.

In FIG. 1, 1 is an armature unit, 2 is solenoid unit, and 3 is a wire unit.

The solenoid unit 2 is arranged between the armature unit 1 and the wire unit 3. These three units 1–3 are connected by fastener 4 and the print head A is thus constructed.

The armature unit 1 has an armature base 6 the rear face of which is strengthened by rib 5. Plural armatures 7 are arranged circularly on the front of the armature base 6 and armature springs 8, having as many spring portions as the armatures 7, are arranged between each armature 7 and armature base 6.

On the center of the armature base 6, an armature stopper 13 is fixed in order to determine the waiting position of the armature 7.

On the front the armature base 6, a projection 9 for guiding the top of armature 7 corresponding to each armature 7, a base side projection 10 for guiding the armature 7 to the armature base 6 upon construction, and a positioning projection 12 for positioning and holding the armature 7 by being inserted in the positioning hole 11 of the armature 7 are provided.

The armature base 6 is formed of liquid crystal polyester of aromatic series polyester resin.

This liquid crystal polymer of aromatic series polymer resin is a kind of a liquid crystal polymer and an aromatic series polyester resin such as "VECTRA" (a trademark of the HOECHST CELANESE CORP.).

"VECTRA" is a firm, high molecular weight polymer and there are very few molecular entanglements because the molecular chain continues to stick together due to being hard to bend even if it is in a molten state.

Therefore, "VECTRA" is characterized by the fact that it may be oriented in one direction by receiving slight shear stress.

"VECTRA" is referred to as a liquid crystal polymer given that it has the characteristics of a crystal in spite of its liquid state.

"VECTRA" has many excellent characteristics produced by such distinctive fine structure.

Particularly the vibration absorption characteristics of "VECTRA" are very excellent despite its high elasticity modulus. This is a unique characteristic which other resins do not have.

Figure 3:
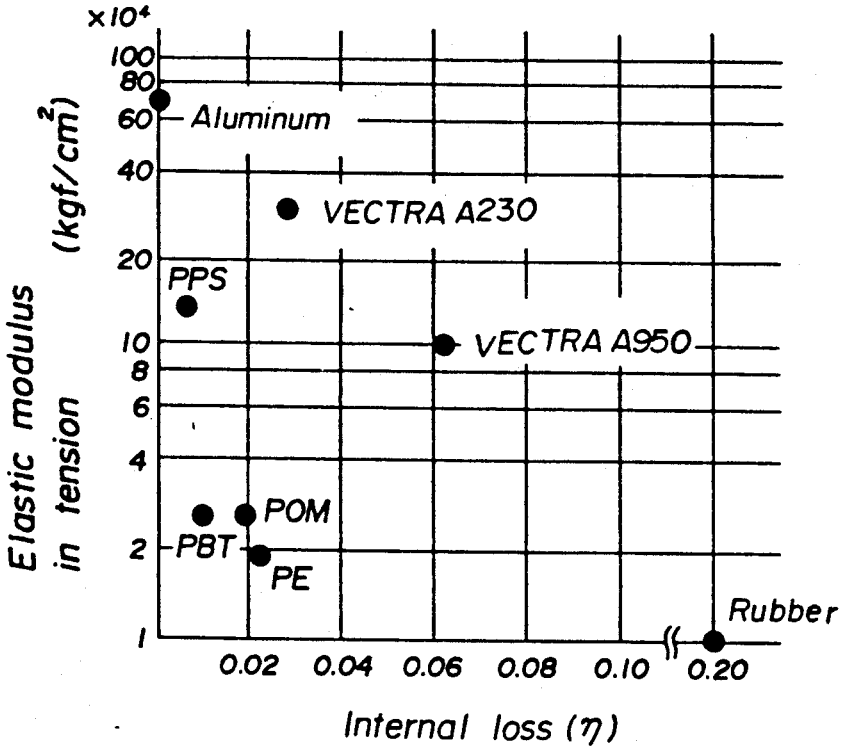
FIG. 3 is a graph showing characteristics of a liquid crystal polymer of an aromatic series polyester resin.

One example of such characteristic is shown in a graph of FIG. 3.

This graph shows the relation between attenuation characteristics and elasticity modulus in various materials.

The ordinate represents the elastic modulus in tension ($kfg/cm^2$) and the abscissa represents internal loss ($\eta$).

Generally, the attenuation (internal loss) of metal materials such as aluminum having a high elasticity modulus is small, and the attenuation of materials such as rubber having low elasticity modulus is large.

Namely, high rigidity is generally contrary to good attenuation properties.

As shown in FIG. 3, "VECTRA" has high attenuation properties despite having a high elasticity modulus.

An object of the present invention is to apply this characteristic of "VECTRA," and like compounds to the armature base of a print head and the like.

The ratio of the internal loss between "VECTRA" and PPS is in the range of 6–10. Namely, the internal loss of VECTRA is 6 to 10 times as much as the internal loss of PPS under similar conditions.

VECTRA is available in various grades, and it has been found by the inventors that VECTRA A950 and VECTRA A230 are both especially suited for use in the present invention. (HOECHST CELANESE has characterized VECTRA A950 as follows:

> "Not recommended for injection molding; surface fibrillation too difficult to control. General purpose base resin used for extrusion and compounding."

and VECTRA A230 as follows:

> "General purpose carbon fiber reinforced grade; very high strength and stiffness; easy flow; electrically conductive; excellent wear/bearing material; exceptionally good chemical resistance and hydrolytic stability."

A typical VECTRA molecule:

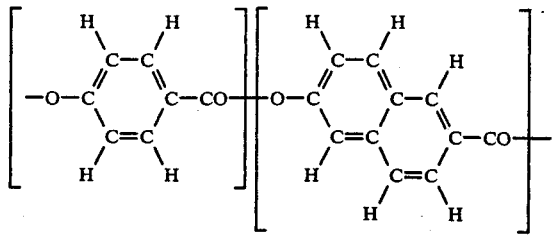

p-Hydroxy Benzoic acid 5-Hydroxy Naphtoic acid

The solenoid unit 2 has a solenoid base 14 which has a cup shape and as many magnetic drive units 15 as armatures 7 which are arranged circularly on bottom surface of the solenoid base 14.

An annular magnetism preventing plate 16 is installed between armature unit 1 and the solenoid unit 2.

Each magnetic drive unit 15 has a core 17 fixed on the solenoid base 14, a bobbin 18 fitted into the core 17 and a solenoid 19 wrapped to the bobbin 18.

On the opposite side of core 17 of the solenoid base 14, a flexible print plate 21 is arranged via an insulator 20. The both ends of the solenoid 19 are soldered to the flexible print plate 21.

The wire unit 3 has a nose 23 fitted onto a cylindrical portion 22 thereof to a center opening of the solenoid base 14 and plural wires 24 slidably guided by the nose 23.

These are as many wires 24 as there are armatures 7. The points are arranged linearly and the rear ends are arranged circularly.

Wire pin 25 is fixed to the rear end of each wire 24. Each wire 24 touches the corresponding armature 7 through the wire pin 25.

26 is a return spring for backing the points of the wires 24 up to the front face of the nose 23 by means of pressing wires 24 toward armature 7.

Figure 4:
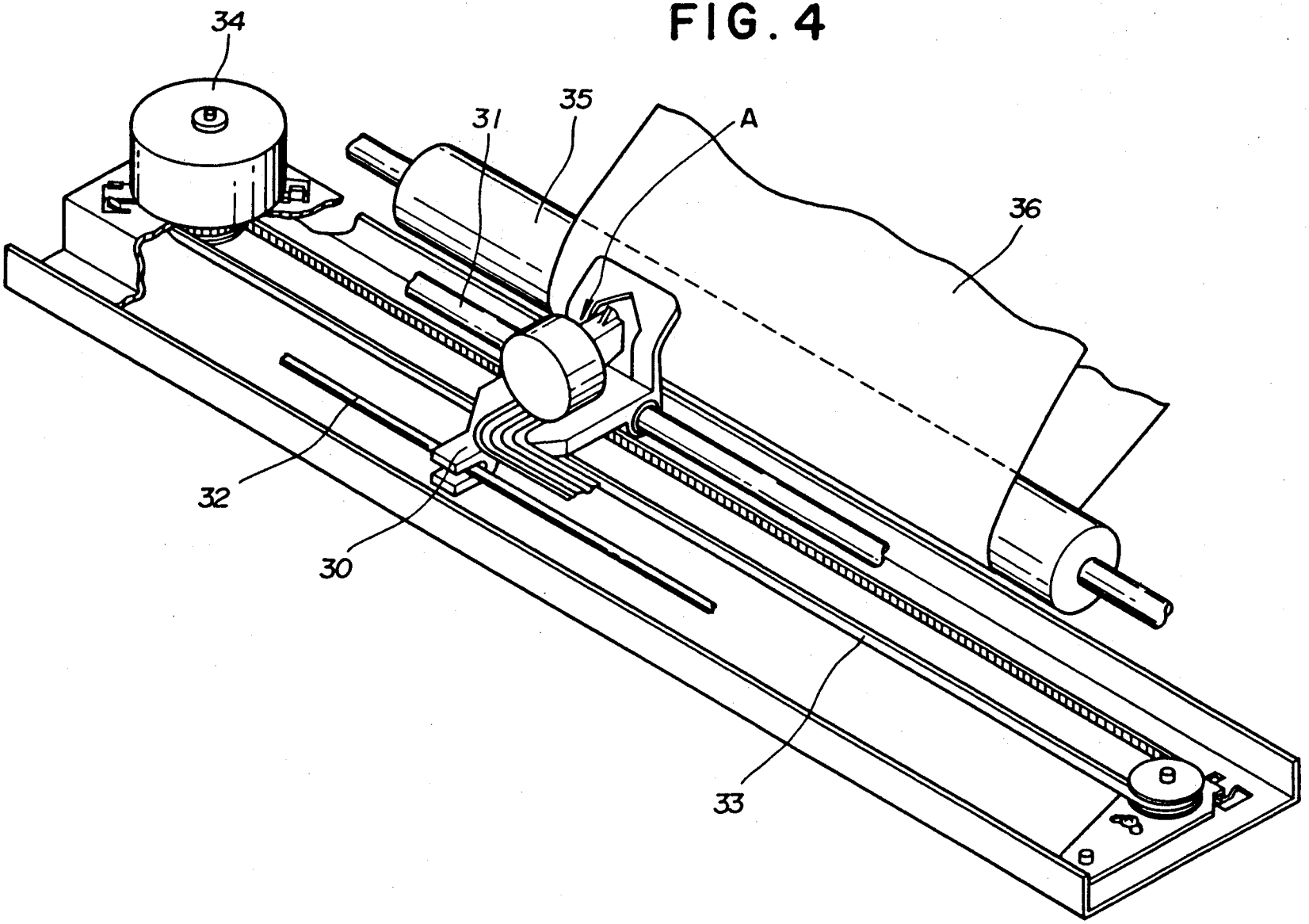
FIG. 4 is a perspective view showing an embodiment in which the print head of the present invention is incorporated.

The print head as described above is incorporated in a printer as shown in FIG. 4.

In FIG. 4, 30 is a carriage body having the print head A installed therein.

The carriage body 30 is slidably held by two guide shafts 31, 32 which are arranged in parallel. 33 is an endless timing belt which is drivable with the carriage body 30. 34 is a motor for driving the timing belt 33.

The carriage 30 is moved reciprocally in the right and left directions on the front face of the platen 35 with the timing belt 33 by means of a driving motor 34.

The action of the present invention will now be described.

If the solenoid 19 of the magnetic drive unit 15 is not energized, the wires 24 are at the back by pressing of the return spring 26 and armature spring 8.

Therefore, the armature 7 touches the armature base 6 through the armature stopper 13.

When the solenoid 19 is energized, the armature 7 is attracted by the core 17 and the armature 7 swings or rotates positioning projection 12 of the armature base 6 as a center.

The armature 7 is thus separated from the armature base 6 by this swinging motion and touches core 17 through the residual 16.

As the rear ends of the wire pins 25 which are fixed on the point of the armature 7 are pressed, the wires 24 are projected from the front surface of the nose 23 and the wires 24 press the paper 36 to the platen 35 through an ink ribbon (not shown).

Thus, the desired print character is dot-printed on a paper 36 which is wrapped around and abutting against platen 35, as seen in FIG. 4.

If the excitation of the solenoid 19 is discontinued, the armature 7 swings back in the opposite direction under the biasing force of the armature spring 8, thereby returning to a starting position in contact with the armature stopper 13.

The wires 24 are backed by pressure of the return spring 26, while following motion of the armature 7. In this case, for every reciprocating movement of the armature 7, this armature 7 bumps one time against the armature base 6 through the armature stopper 13.

Given that the armature base 6 is formed from a liquid crystal polymer of aromatic series polyester resin having excellent vibration attenuation characteristics vibration caused by the colliding with or bumping of armature 7 is absorbed by armature base 6.

Therefore, loud noise is not generated even though the armatures 7 bump the armature base 6 continuously.

Armature base 6, formed from a liquid crystal polymer of aromatic series polyester resin, has both resistance to thermal deformation properties and resistance to wear, which properties are required for armature base 6. In addition to excellent vibration attenuation characteristics as described above, this armature base 6 does not deform under the influence of heat or wear even if printing by continuous driving of the magnetic drive unit 5 occurs for a long time. In other words, both noise is reduced and thermal and abrasion resistance are achieved even under prolonged use conditions.

If the liquid crystal polymer of the aromatic series polyester resin is used as the material of nose 23 or carriage body 30, it may efficiently prevent transmission of vibrations occurring at the print head to the frame from the nose 23 or the carriage body 30 through the guide shafts 31, 32.

Therefore, if the nose 23 and carriage body 30 are formed from a liquid crystal polymer of the aromatic series polyester resin, it will be able to efficiently prevent the generation of noise from the frame and other parts.

The foregoing is simply a description of preferred embodiments of Applicants' invention, and should not be construed as limiting the scope of the invention in any manner. All variations possible within the scope of the appended claims are to be considered as coming with the bounds of the invention.

We claim:

1. In a dot matrix print head for dot printing by wires projecting therefrom, which comprises a plurality of movable armatures for controlling the movement of said wires, the improvement comprising means for reducing noise and damping vibrations including an armature base formed from a liquid crystal polymer of an aromatic series polyester resin, said armature base disposed adjacent said armatures in the print head to arrest the movement thereof and to reduce noise and dampen vibrations tending to be generated by impacts occurring during the arresting of the movement of the armatures.

2. A device as in claim 1, further comprising a drive unit for actuating said plurality of armatures.

3. A dot-matrix print head for a printing comprising:

a plurality of printing wires having first and second ends, each of said first ends of said plurality of printing wires being means for facilitating the printing of a dot,;

means for slidably supporting said printing wires in the print head;

a plurality of reciprocably movable armatures, each one of said plurality of reciprocable armatures contacting or connected to a respective one of said second ends of said plurality of printing wires for individually moving each one of said plurality of wires;

actuating means operatively associated with said armatures for reciprocably individually moving each one of said plurality of reciprocable armatures to in turn reciprocably move each one of said plurality of printing wires, said actuating means moving each one of said plurality of armatures in a first direction for causing said first ends of said plurality of printing wires to facilitate the printing of dots, and said actuating means moving each one of said plurality of armatures in a second, return direction for returning each one of said plurality of armatures and printing wires to a rest position; and means for reducing noise and damping vibrations including an armature base disposed adjacent to each one of said plurality of armatures for arresting movement of each one of said plurality of armatures when returned to its rest position, said armature base being a liquid crystal polymer of aromatic series polyester having a high modulus of elasticity so as to inhibit noise caused by impacts produced by said armatures on said armature base, and a vibration absorption property so as to dampen vibrations also tending to be generated by impacts occurring during the arresting of the movement of the armatures.

4. A device as in claim 3, wherein said means for slidably supporting said plurality of printing wires includes a nose slidably receiving each one of said plurality of printing wires, and said noise is a liquid crystal polymer of aromatic series polyester, having a high modulus of elasticity, for preventing transmission of vibrations from said plurality of printing wires through said nose, and having high thermal deformation and wear resistance properties.

* * * * *